US005646638A

United States Patent [19]

Winegard et al.

[11] Patent Number: 5,646,638

[45] Date of Patent: *Jul. 8, 1997

[54] PORTABLE DIGITAL SATELLITE SYSTEM

[75] Inventors: John Randall Winegard; Randy Lee Sperry, both of Burlington, Iowa

[73] Assignee: Winegard Company, Burlington, Iowa

[ * ] Notice: The term of this patent shall not extend beyond the expiration date of Pat. No. 5,528,250.

[21] Appl. No.: 453,909

[22] Filed: May 30, 1995

[51] Int. Cl.[6] ..... H01Q 3/02

[52] U.S. Cl. ..... 343/882; 343/840; 343/880; 343/881

[58] Field of Search ..... 343/880, 881, 343/882, 840, 915, 711; H01Q 15/16, 15/20, 1/08

[56] References Cited

U.S. PATENT DOCUMENTS

| | | | |
|---|---|---|---|
| 4,868,578 | 9/1989 | Bruinsma et al. | 343/880 X |
| 4,994,816 | 2/1991 | Kondo | 343/882 X |
| 4,998,114 | 3/1991 | Eto et al. | 343/882 X |
| 5,334,990 | 8/1994 | Robinson | 343/880 X |
| 5,337,062 | 8/1994 | Sherwood et al. | 343/711 |
| 5,528,250 | 6/1996 | Sherwood et al. | 343/711 |

FOREIGN PATENT DOCUMENTS

| | | | |
|---|---|---|---|
| 0010804 | 1/1985 | Japan | 343/840 |
| 0075603 | 4/1986 | Japan | H01Q 1/08 |
| 0284101 | 12/1986 | Japan | H01Q 1/08 |
| 5063434 | 3/1993 | Japan | H01Q 15/16 |

*Primary Examiner*—Donald T. Hajec
*Assistant Examiner*—Tho Phan
*Attorney, Agent, or Firm*—Dorr, Carson, Sloan & Birney, P.C.

[57] ABSTRACT

A portable satellite dish antenna system for carrying by a user to a remote location. The system includes a base mount having a peripheral edge with a handle formed thereon. A length of cable is stowed in a carrier in the mount. A pivoting mechanism is connected to the dish and to the mount to move the dish between a carrying position and a deployed position. In the carrying position, the dish is held parallel to the mount and the handle. The mount has a formed opening opposite the handle. This enables the feed horn, when in the carrying position, to locate in the formed opening, thereby reducing the space between the dish and the mount during carrying. The user of the system grips the handle and twists the mount in a direction to align the dish with a desired direction based on a compass reading located on the mount. The mount has a formed linear track located between the handle and the formed opening having a plurality of elevation marks. The pivoting mechanism slideably engages the track as the dish moves between the carrying position and the deployed position. In setting up the dish in the deployed position, the user knows the predetermined elevation mark in which to slide the pivoting mechanism to so as to locate the desired satellite.

7 Claims, 9 Drawing Sheets

Fig. 7(a)
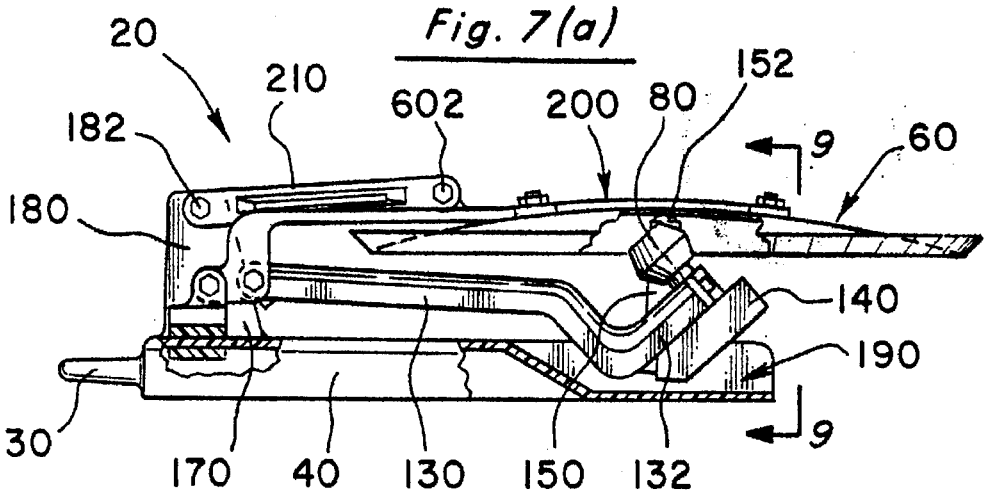
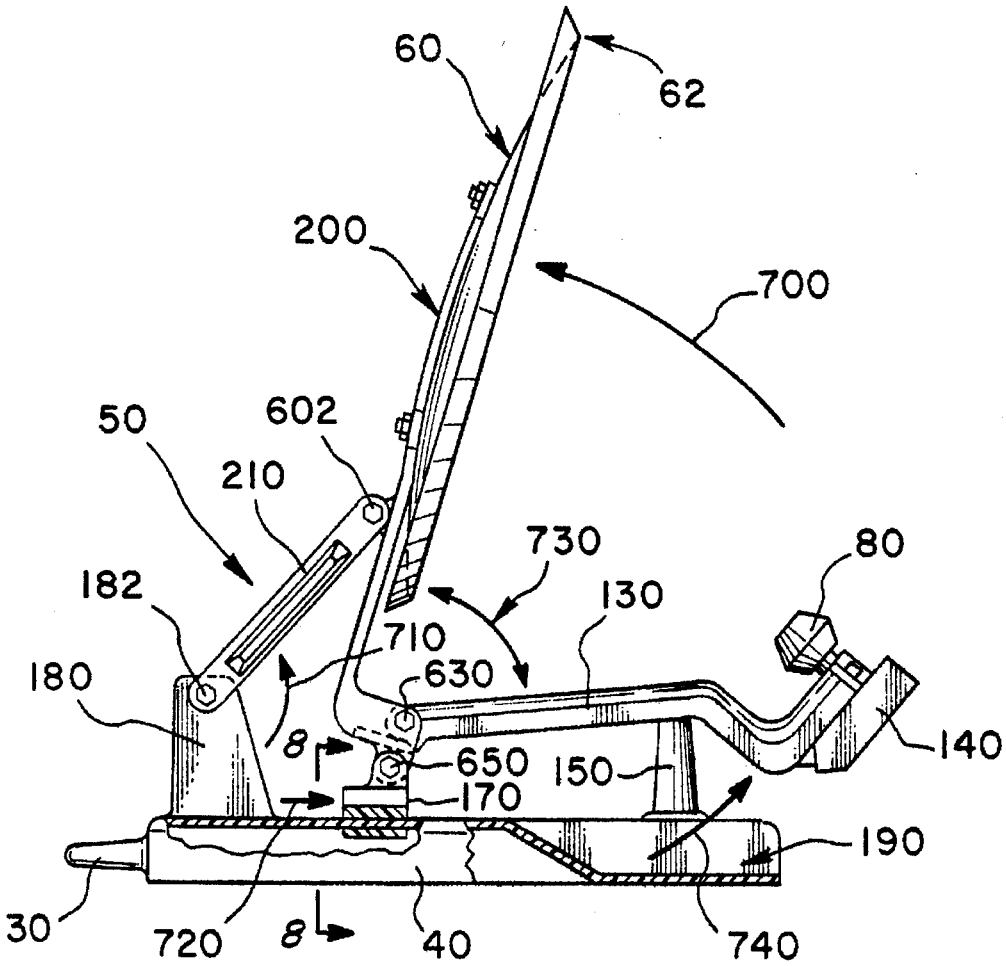
Fig. 7(b)

Fig. 8
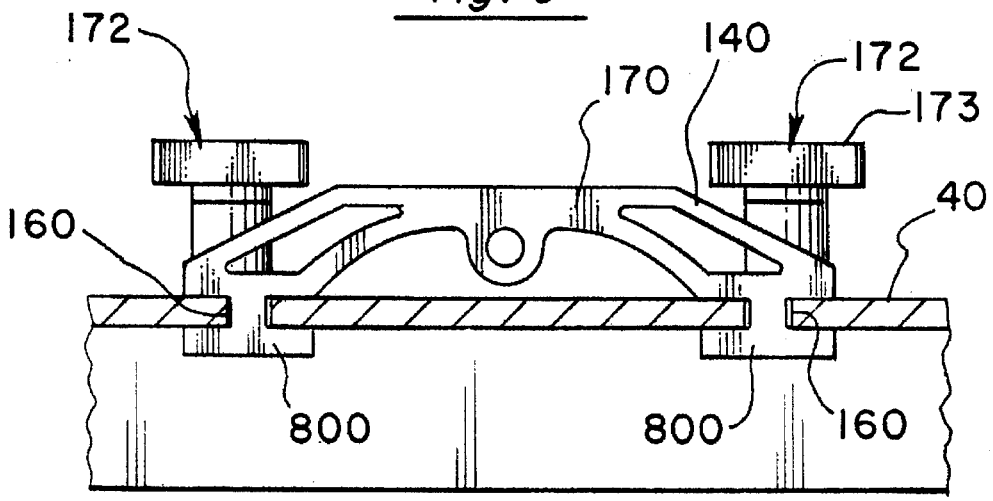
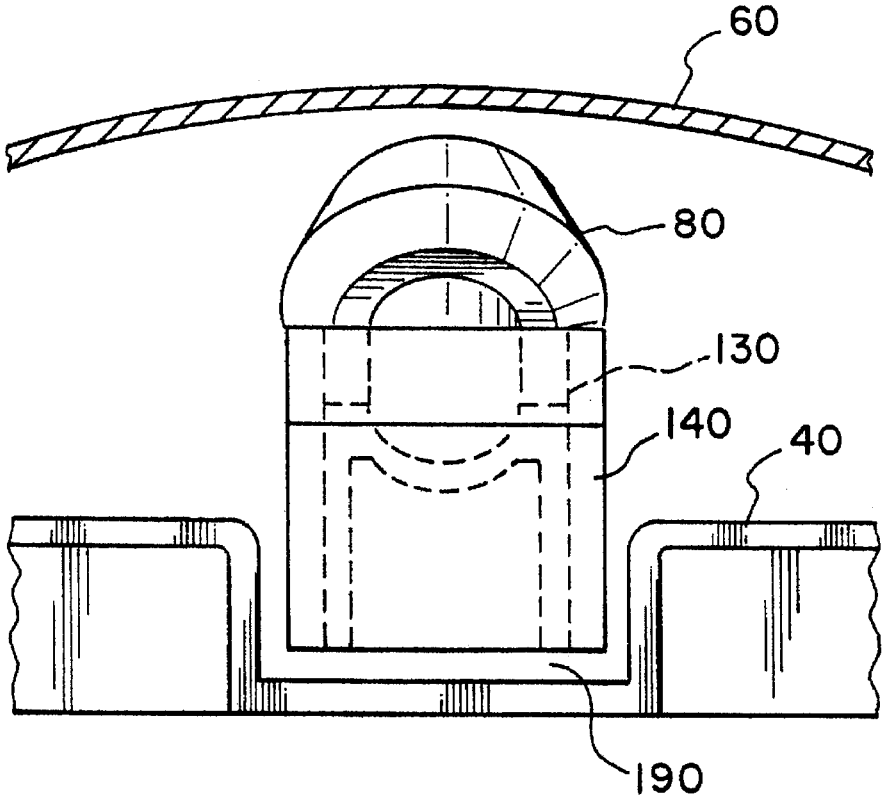
Fig. 9

PORTABLE DIGITAL SATELLITE SYSTEM

BACKGROUND OF THE INVENTION

1. Field of the Invention

The present invention relates generally to the field of satellite dish antennas. More specifically, the present invention relates to a portable satellite dish antenna for a digital satellite system that can be easily moved to a remote location, set up, and tuned to a satellite.

2. Statement of the Problem

Satellite programming has been enjoyed by many individuals throughout the United States and the world. Recently, a new small satellite dish antenna system termed Digital Satellite System (DSS) has been introduced to the consuming public.

A need exists to make such DSS antennas portable so that people who own recreational vehicles, who camp, or who desire to have a portable dish antenna may make full use of the available DSS programming.

Video Output Manufacturing, Inc., provides a portable satellite dish system sold under the trademark BOUY that incorporates a handle into a base mount and provides a storage area in the base mount for water or sand to hold an 18 inch satellite dish when deployed. This portable satellite dish mount incorporates a compass and a level for orienting the dish. The dish when deployed extends upward at one corner of the base mount, making the system somewhat unstable without the required added weight provided by the sand or water in the base mount.

SEL Elettronica provides a portable satellite dish antenna for campers. The small dish antenna is provided as a kit in a carrying case. The kit contains the dish antenna, a low-noise amplifier, a receiver, an antenna connection cable, and a suction cup for holding the antenna. The user of this antenna system must assemble and disassemble the antenna at each location. When assembled, the dish is deployed well over the outer periphery of the suction cup, thereby requiring the suction cup to strongly engage the mounting surface. The system cannot be mounted to earth.

U.S. Pat. No. 5,337,062 entitled "Deployable Satellite Antenna for Use on Vehicles" pertains to a non-portable, fixedly mounted antenna on the roof of the vehicle. The dish is moved between a stowed position with the antenna stowed facing the roof of the vehicle and a deployed position in which the antenna is directed at a satellite. A powered pivot mechanism is used to pivot the dish between the stowed and the deployed positions, and a powered rotating mechanism is used to adjust the azimuth of the antenna.

A need exists for a portable satellite dish antenna that does not require assembly or disassembly and that does not require loading or unloading of water or sand. The dish antenna should be supported on the ground and should provide an environment which the dish is deployed over the mount for stability. The dish antenna must be capable of being quickly moved between the deployed state and the carrying state.

3. Solution to the Problem

None of the prior art portable satellite dish systems discussed above set forth a portable deployable antenna system that does not require assembly or disassembly and that does not require the use of loading or unloading weighted material such as water or sand.

The present invention provides a solution to the above problem by providing a system that deploys the dish directly over the base mount for stability. The present invention further provides a system that does not require loading or unloading of a weight such as sand or water into a container formed in the mount. Finally, the present invention does not require assembly or disassembly. The present invention is based upon the design of U.S. Pat. No. 5,337,062, but improves upon this design by eliminating the powering of the pivot mechanism and by eliminating the entire rotating mechanism while adding a cable carrier, a handle, a level, a compass, elevation marks, and a more compact stowed design.

SUMMARY OF THE INVENTION

A portable satellite dish antenna for carrying by a user to a remote location is disclosed. The portable satellite dish antenna of the present invention includes a base mount with the base mount having a peripheral edge therearound. A handle is formed on a portion of the peripheral edge. The handle engages the peripheral edge so that when the user grips the handle, the mount is held in a substantially vertically orientation along the leg of the user during carrying of the antenna. A length of cable is also provided and is stored in a formed region in the mount. A DSS dish is provided as well as a feed arm having first and second ends. A feed is connected to the first end of the feed arm and an amplifier is connected to the feed. A pivoting mechanism is connected to the dish and to the mount in order to move the dish between a carrying position and a deployed position.

In the carrying position, the dish is held in a substantially parallel orientation against the mount. Furthermore, the mount has a formed opening in a portion of the peripheral edge opposite the handle. This enables the feed, when in the carrying position, to locate in the formed opening, thereby reducing the space between the dish and the mount during carrying.

When the dish is in the deployed position, it is located over the mount, which increases stability. A level allows the user to position the mount on the surface in a level orientation. A compass is also located on the mount. The user of the antenna of the present invention will grip the handle and turn the mount in a direction to align the dish with a desired direction. This provides azimuth tuning of the dish. The handle is located on the rear side of the dish so that the user does not interfere with the reception of any signal required for fine tuning.

The mount has a formed linear track located between the handle and the formed opening. A plurality of elevation marks are located along the formed linear track. The pivoting mechanism slideably engages the track as the dish moves between the carrying position and the deployed position. In setting up the dish in the deployed position, the user will know the predetermined elevation mark to which to slide the pivoting mechanism so as to approximately locate the desired satellite. At that point, the user can slowly move the pivoting mechanism to obtain the best possible signal. Thumb screws are used to lock the pivoting mechanism to the base mount to secure the fine-tune position.

BRIEF DESCRIPTION OF THE DRAWING

FIG. 8 is a front planar view of the sliding mechanism of the present invention, FIG. 9 sets forth a front planar view of the satellite dish antenna of the present invention setting forth the details of the formed opening for stowing the feed during carrying.

DETAILED DESCRIPTION OF THE INVENTION

1. Brief Overview

Figure 1:
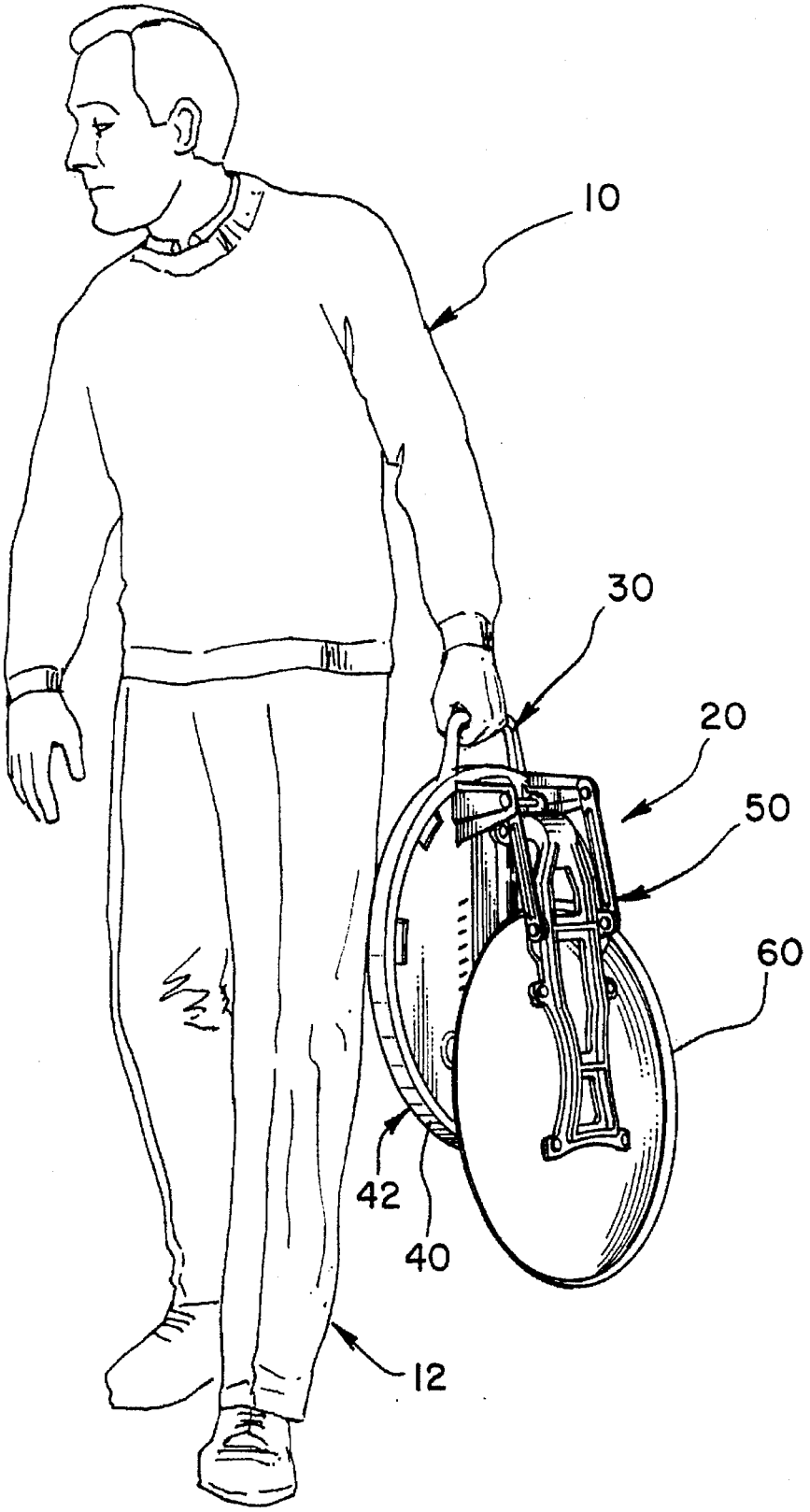
FIG. 1 sets forth an illustration of a user carrying the satellite dish antenna of the present invention, use, FIG. 2 sets forth a rear perspective view of the satellite dish antenna of the present invention in a deployed position.
Figure 2:
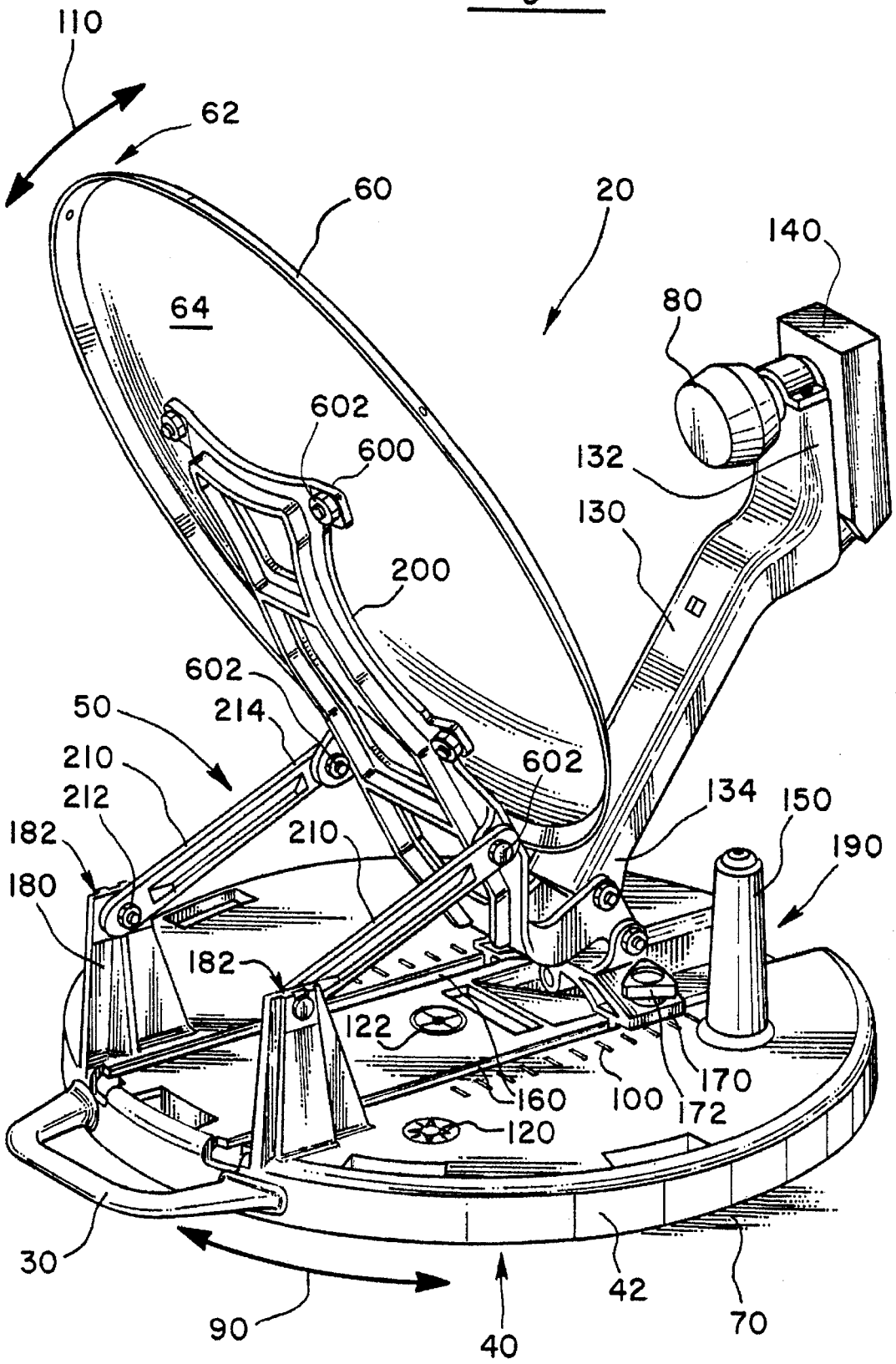
Figure 3:
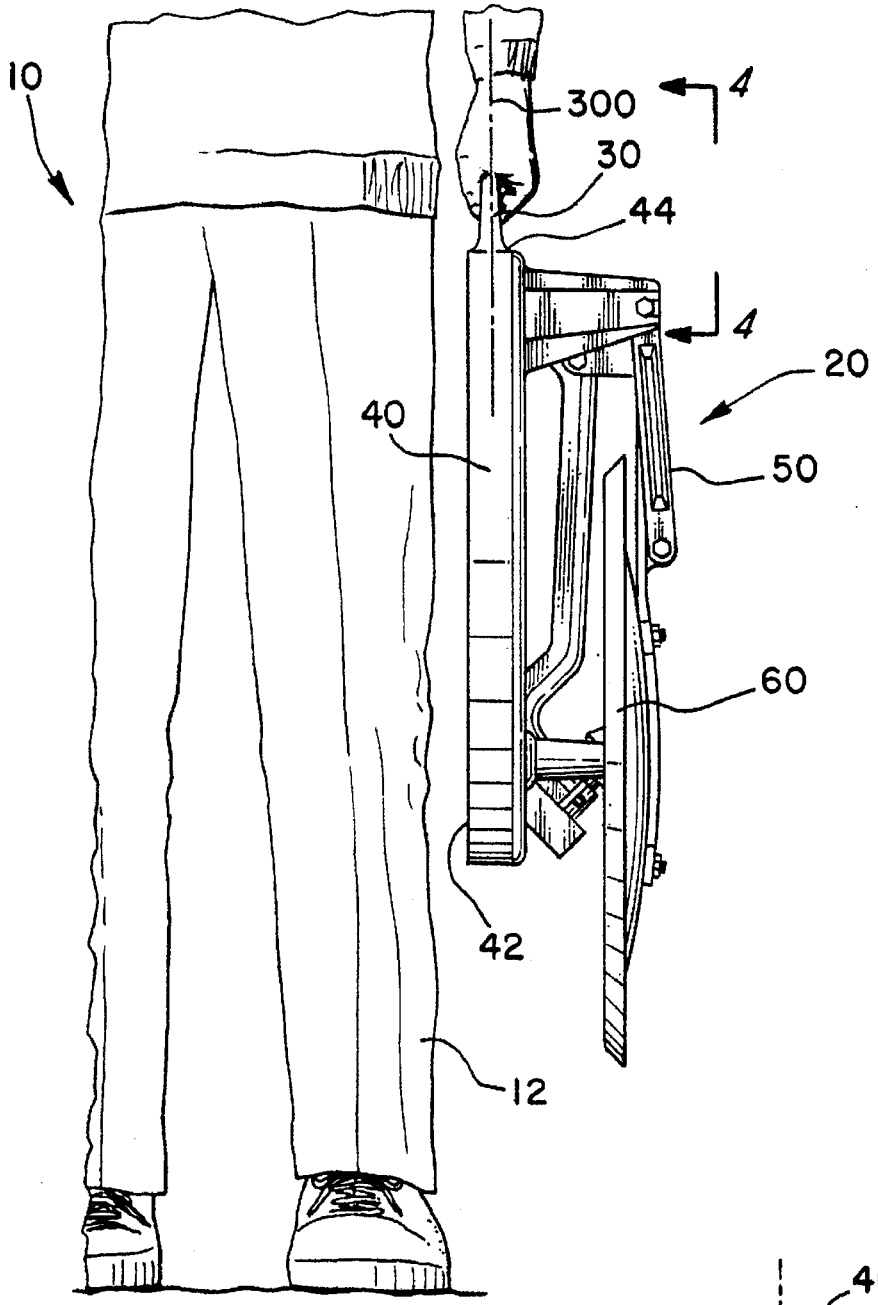
FIG. 3 is a front elevational view of the satellite dish antenna of FIG. 1 in the carrying position alongside the leg of a user.

In FIGS. 1, 2, and 3, the portable DSS antenna of the present invention is set forth in the carrying position and in the deployed position.

FIGS. 1 and 3 show a user 10 carrying the antenna 20 of the present invention. The antenna 20 of the present invention has a handle 30 connected to a circular mount 40. The mount 40 can be of any desired geometric shape. On the mount 40 is a pivoting mechanism 50 for deploying the dish 60. As shown in FIG. 1, the user 10 carrying the portable DSS antenna 20 of the present invention holds it in a substantially vertical orientation with the mount 40 facing the person 10 and with the dish 60 directed away from the person 10. In this orientation, the person 10 can easily carry the antenna 20 for long distances to a remote location since the facing side 42 of the mount 40 is close to the leg 12 of the person 10. This provides a comfortable carrying design with the dish 60 away from the user 10.

In FIG. 2, the antenna 20 is shown fully deployed on the ground 70 at a remote location. In the fully deployed position, the dish 60 receives signals from a satellite, not shown, and delivers those signals into a feed horn 80. The mount 40 sits firmly on the ground 70. To tune in the antenna 20 to a particular satellite, the user 10 first makes sure the antenna 20 is level by using a bubble level 122 centrally located on the mount 40.

The azimuth adjustment occurs by gripping the handle 30 and turning the system in the direction of arrow 90 to a desired direction as read in compass 120. The handle is located to the rear 64 of the dish 60 so that the user 10 during azimuth tuning 90 does not interfere with the received signal. The elevation for the dish 60 is determined through reference to built-in hash marks 100 indicating degrees of elevation. The user 10 grips the dish at area 62 and moves it in the direction of arrow 110. Again, the user 10 does not interfere with the received signal during elevation tuning 110. The user 10 remains in the same physical location during both manual azimuth and elevation tuning. Once the dish 60 is correctly tuned into a desired satellite, thumb screws 172 are turned to lock deployed dish 60 to the mount 40.

In summary, it can observed in FIGS. 1 and 2 that a user 10 can quickly collapse or deploy the portable DSS antenna 20 of the present invention and can easily transport the antenna 20. In the following sections, the details of the present invention are set forth with more clarity.

2. Handle 30

Figure 4:
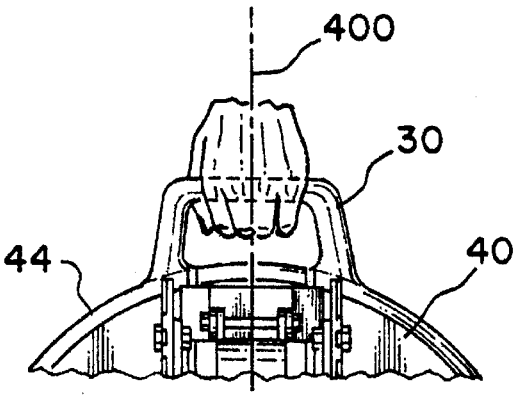
FIG. 4 is a partial side planar view setting forth the details of the handle mounted on a portion of the peripheral edge of the base mount.

In FIGS. 3 and 4, the details of the handle 30 are shown. As shown in FIG. 3, the handle 30 is oriented on the exterior surface 44 of the mount 40. The side 42 of the mount 40 faces the leg 12 of the user 10 during carrying. Hence, the facing surface 42 of the mount 40 is in substantially parallel relationship with the leg 12. There may be a slight tilt of the bottom of the facing surface 42 toward the leg 12. This provides a comfortable carrying orientation of the satellite dish antenna 20 of the present invention. In the preferred embodiment and as shown in FIG. 4, the handle 30 is generally U-shaped in configuration and is molded into the mount 40. It is to be expressly understood that the handle 30 can be of any desired configuration or shape and it is immaterial whether the handle 30 is molded or connected to the mount 40. The handle 30 is preferably located over the center-line 400 of the mount 40. However, the handle may be connected to any desired location on the mount 40 other than on the peripheral edge.

3. Details of DSS Antenna 20

Figure 5:
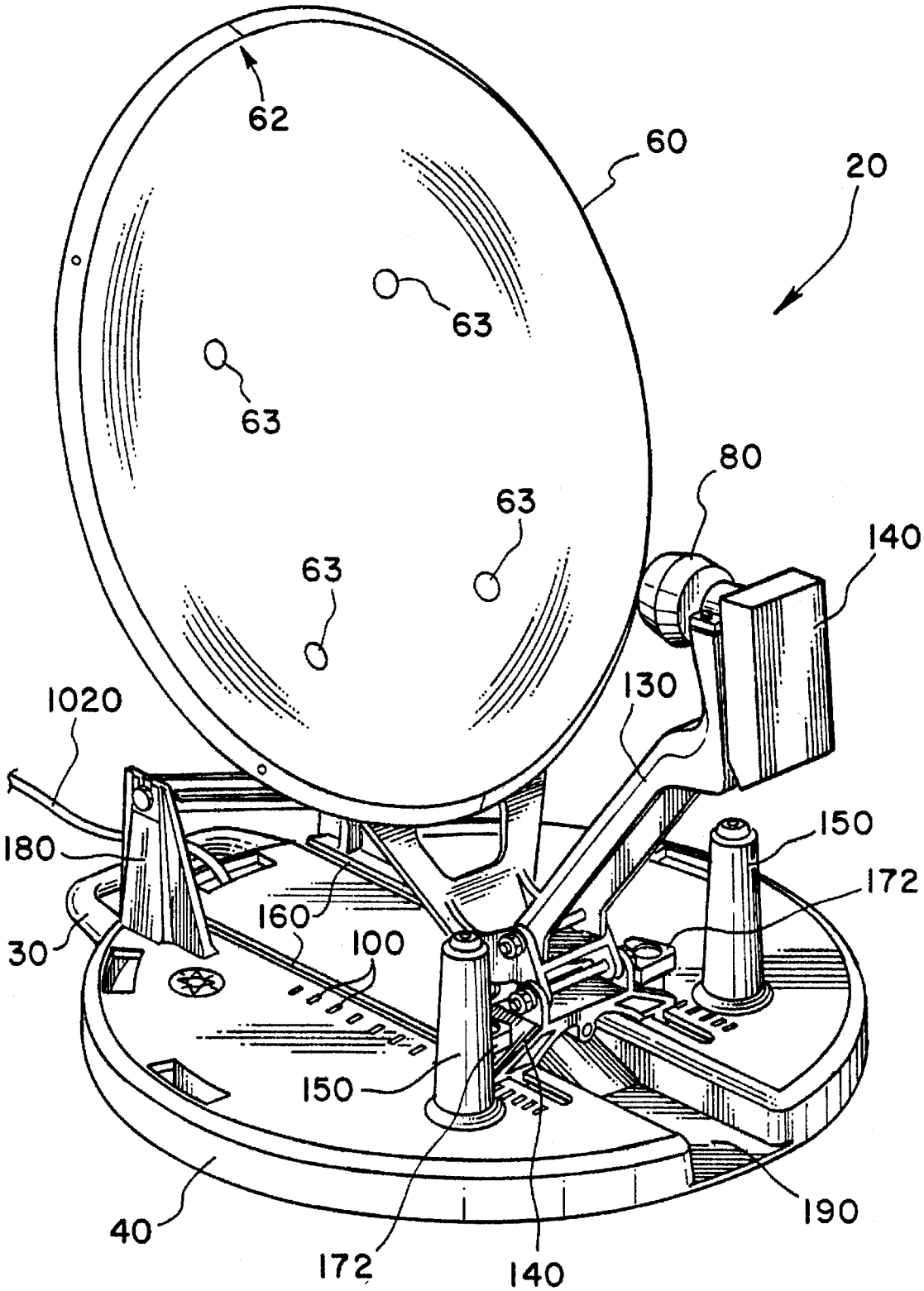
FIG. 5 is a perspective view of the front of the deployed satellite dish antenna of FIG. 2.

In FIGS. 2 and 5 are set forth the details of the various components of the DSS antenna 20 of the present invention. The dish 60 is of parabolic design that is used to receive digital signals from a desired satellite. Typically dish 60 is 18 inches in diameter and is formed from metal.

In FIG. 2, the base mount 40 supports the dish 60 in a deployed position. The system 20 also includes the pivoting mechanism 50 and, a feed arm 130 having a feed horn 80 mounted at a first end 132 and being connected at the second end 134 to the pivoting mechanism 50. Also mounted to the feed 80 is an amplifier 140. In the deployed position of FIG. 2, the feed 80 is in the focus of the dish 60 to receive programming. Also connected to the base mount 40 are a pair of support posts 150. The support posts 150, as will be explained subsequently, support the dish 60 in the carrying position. Also found on the base mount 40 are elevation hash marks 100 and a compass 120. The elevation hash marks 100 are along a pair of parallel tracks 160 on which a slider mechanism 170 is mounted. A user 10 standing behind the system 20 grips the antenna dish 60 at region 62 and pulls or pushes in a direction of arrow 110 to put the antenna dish 60 in the carrying position or to fully deploy the antenna dish 60 by placing it at a desired elevation angle at a particular hash mark 100. The antenna dish 60 is then locked into position by thumb screws 172.

Also found on the mount 40 are a pair of upstanding supports 180 to which the pivoting mechanism 50 is pivotly connected. A region 190 is formed in the peripheral edge 42 of the mount 40 opposite the handle 30.

Figure 6:
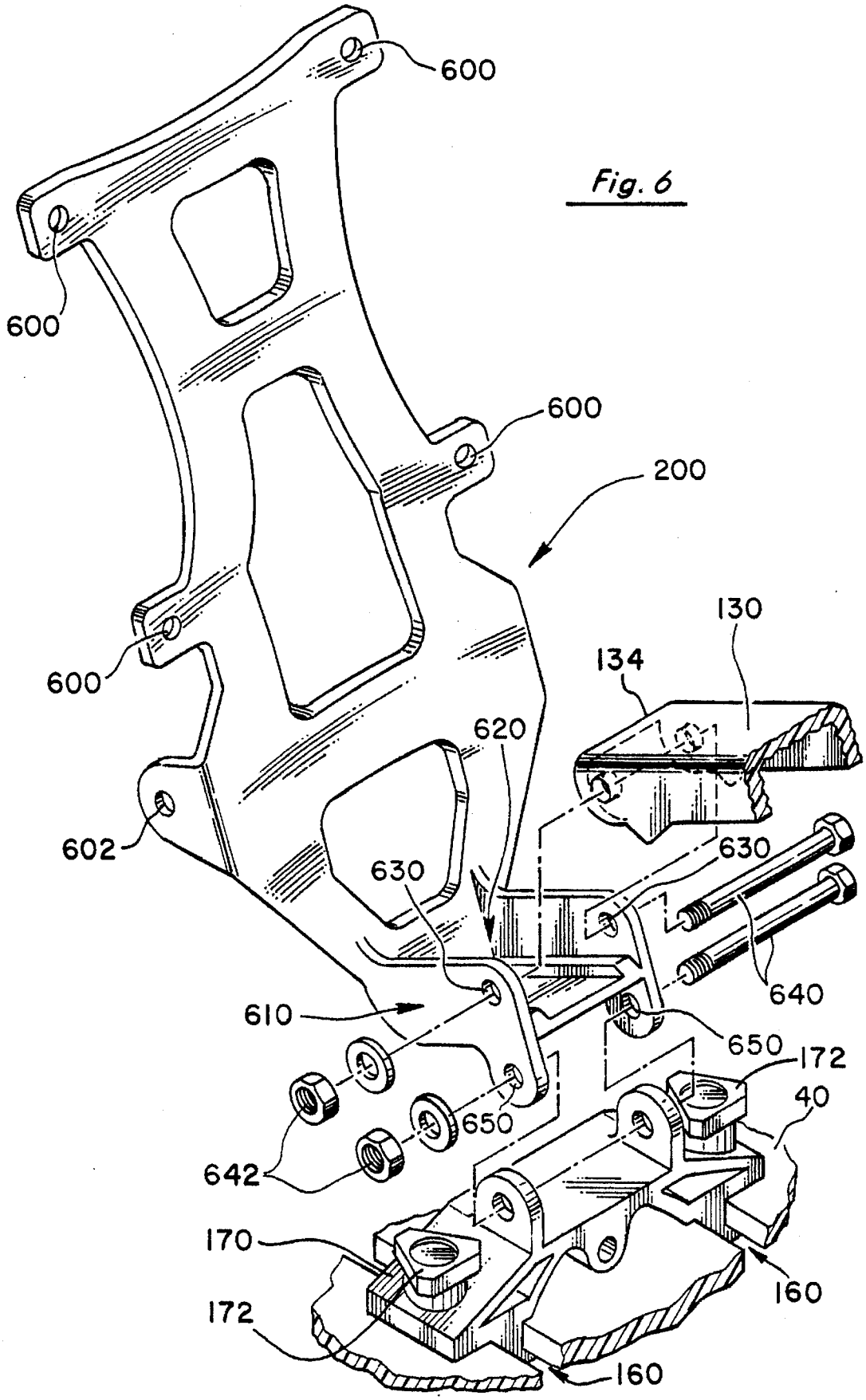
FIG. 6 is a perspective view of the frame assembly of the present invention, FIGS. 7 (*a*), (*b*), and (*c*) set forth, in diagrammatic form, the movement of the satellite dish antenna of the present invention from the carrying position to the deployed position.

The pivoting mechanism 50 includes a frame assembly 200, pivot arms 210, the slider assembly 170, and various connectors such as nuts and bolts. In FIG. 5, the dish 60 has four formed connecting points 63. In FIG. 6, the frame assembly has four corresponding connecting pads 600 that receive connectors 604 for firmly attaching the dish 60 to the frame assembly 200. The supports 180 located on either side of the tracks 160 have a connection point 182 to which one end 212 of the pivot arm 210 is connected. The other end of the pivot arm 214 is connected to connection points 602 on the frame assembly 200. Hence, the frame assembly 200 is pivotly connected to the mount 40 through the pivot arms 210. Two points of pivot are provided at 182 and 602.

As shown in FIG. 6, the lower portion 610 of the frame assembly 200 has a formed cavity 620. The second end 134 of the feed arm 130 is connected into the formed cavity 620 at connection points 630. Suitable connectors 640 and 642 are used to attach the feed arm 130 to the frame assembly 200. Finally, the frame assembly 200 has connection points 650 that mount to the slider mechanism 170. The slider mechanism 170 slides along the tracks 160 with the frame assembly 200 pivoting about points of connection 650. In operation, the frame assembly 200 pivots with respect to the mount 40 at connection points 182 and 602.

4. Carrying and Deployed Positions

Figure 7C:
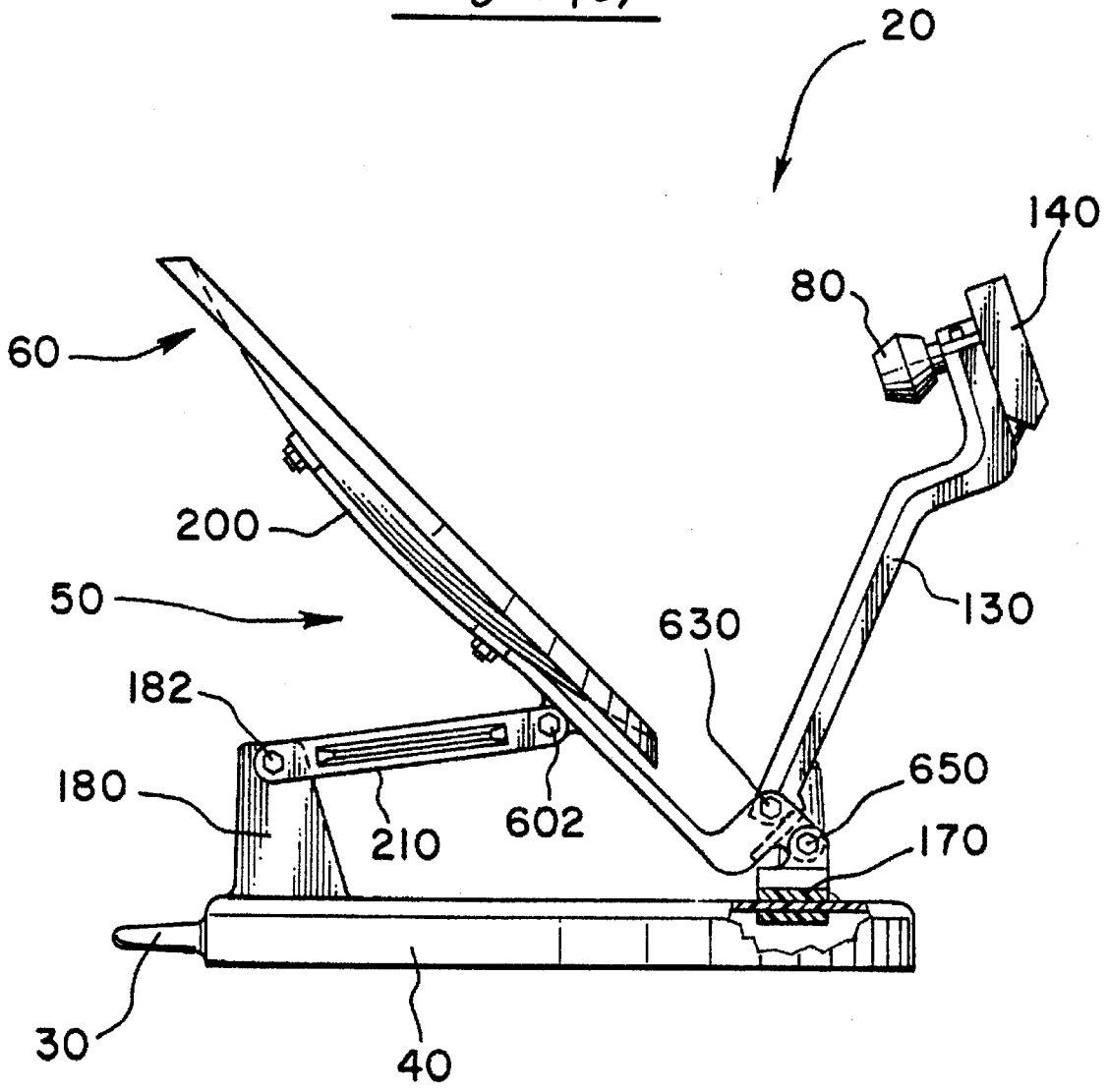

In FIG. 7, the system 20 of the present invention is shown in the carrying position (FIG. 7*a*) and in the deployed position (FIG. 7*c*). FIG. 7*b* represents movement of the dish 60 between these two positions.

In the carrying position shown in FIG. 7*a*, the amplifier 140 and the upper end 132 of the feed arm 130 are stowed in the formed opening 190. The dish 60 is in substantially parallel relationship to the mount 40. The feed horn 80 is directed inwardly toward the center of the dish 60. By placing the amplifier 140 and the upper end 132 of the feed arm 130 in the formed opening 190, the system 20 becomes highly compact and, as shown in FIG. 3, easily transportable. In FIG. 9, the tucking of the amplifier 140 and the feed arm 130 in the formed opening 190 is further illustrated. The support posts 150, as shown in FIG. 7*a*, engage the satellite dish to the slider in the carrying position. The support posts 150 alleviate strain from assembly 170 and protect the amplifier 140 from damage. It is to be understood that the posts 150 can be of any suitable shape or design and that while two are shown, one or more than two could be utilized.

In FIG. 7*b*, the antenna dish 60 is lifted in the direction of arrow 700 by the user 10 gripping in region 62 and manually activating the dish 60 to move toward the deployed position. This causes pivot arms 210 to move upward in the direction of arrow 710 and the sliding mechanism 170 to move in the direction of arrow 720. Initially, only the dish 60 pivots upward in the direction of arrow 700. The feed arm 130 with the feed horn 80 and the amplifier 140 remain in the formed cavity 190. At a given distance in travel, the feed arm 130 automatically reaches an angular relationship 730 with the dish 60 and at that point further movement of the dish 60 in the direction of arrow 70 causes the feed arm 130 to move upward in the direction of arrow 740. This angular relationship 730 is such that the feed 80 is in the focal area of dish 60.

In FIG. 7*c*, the deployment of the dish antenna 60 of the present invention is shown. In this position, the pivoting mechanism 50 is locked into the base mount 40 with the thumb screws 172.

5. Cable Carrier

Figure 10:
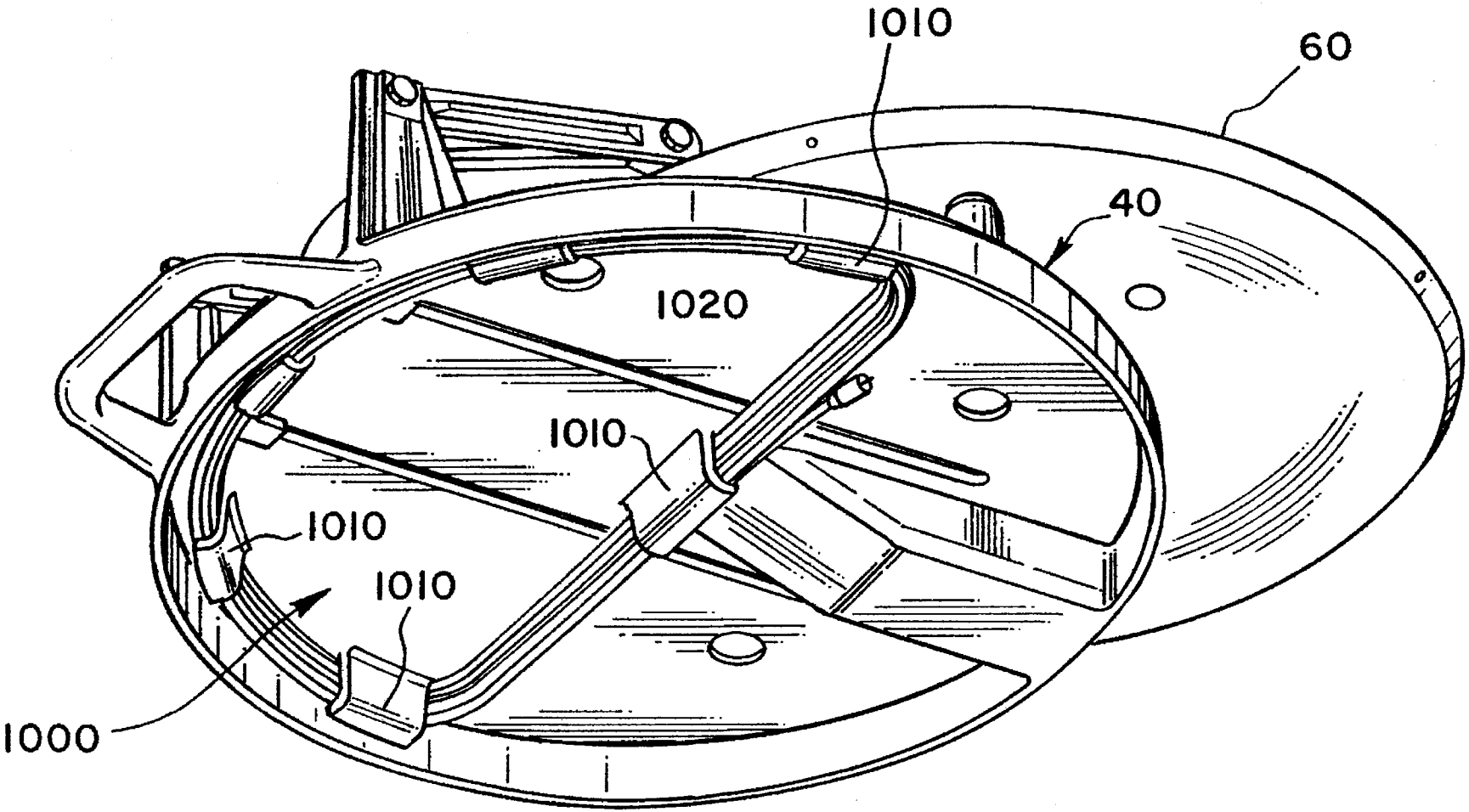
FIG. 10 is a bottom perspective view of the satellite dish antenna of FIG. 2 showing the cable carrier.

In FIG. 10, the underside of the mount 40 has a formed cavity 1000 in which are placed a number of cable hooks 1010. As shown, the cable 1020 is looped around the cable hooks 1010 and conveniently stored for carrying. Since the cable 1020 is heavy, the positioning of the cable 1020 in the formed region 1000 occurs along the center line 300 of the mount 40 as shown in FIG. 3. Again, the location of the cable 1020 at this point aids in the carrying of the stowed antenna.

6. Thumb Screws

In FIG. 8, the details of the slider mechanism 170 engaging the tracks 160 is illustrated. Guides 800 firmly engage the slider 170 into the mount 40. The slider mechanism has a nut 173 that engages a bolt engaging the guide 800. When in position, the nut 173 is turned to cause the guide 800 to firmly engage the track 160 against the slider 170 to prevent movement. While two thumb screws 172 are shown, it is to be understood that one would suffice to lock the pivoting mechanism 50 to the mount 40.

It is to be expressly understood that the thumb screws 172 function to provide a lock connected between the mount 40 and the pivoting mechanism 50 for securing the dish 60 in the deployed position. Any suitable lock could be utilized to accomplish this result. For example, a thumb screw could be used to tighten down any pivoting area such as 182 to firmly hold the pivoting mechanism in position.

The invention has been described with reference to the preferred embodiment. Modifications and alterations will occur to others upon a reading and understanding of this specification. This specification is intended to include all such modifications and alterations insofar as they come within the scope of the appended claims or the equivalents thereof.

We claim:

1. A portable satellite dish antenna for carrying by a user to a remote location, said portable satellite dish antenna comprising:

a mount, said mount having a peripheral edge, said mount having a formed region through a portion of said peripheral edge, a dish, a feed arm having first and second ends, a feed horn connected to said first end of said feed arm, a pivoting mechanism connected to said dish and to said mount, said pivoting mechanism manually activated by said user to entirely move said dish between a carrying position and a deployed position, said dish held in a substantially parallel position to said mount when in said carrying position, said feed horn and said feed arm located in said formed region between said dish and said mount in said carrying position, and said second end of said feed arm pivotally connected to said pivoting mechanism for automatically moving said feed horn to a focal area when said dish is moved to said deployed position.

2. The portable satellite dish antenna of claim 1 further comprising:

a lock connected to said pivoting mechanism, said lock securing said dish in said deployed position.

3. The portable satellite dish antenna of claim 2 wherein said lock is at least one thumb screw connected between said mount and said pivoting mechanism.

4. The portable satellite dish antenna of claim 1 further comprising at least one post between said dish and said mount to support said dish in said carrying position.

5. The portable satellite dish antenna of claim 1 further comprising an amplifier connected to said feed horn.

6. The portable satellite dish antenna of claim 1 further comprising a handle on said peripheral edge of said mount, said handle holding said mount in a substantially vertical orientation along the side of said user when gripped by said user during said carrying.

7. The portable satellite dish antenna of claim 1 further comprising:

a length of cable, and a formed region in said mount for holding said length of cable.

* * * * *

UNITED STATES PATENT AND TRADEMARK OFFICE

CERTIFICATE OF CORRECTION

PATENT NO. : 5,646,638

DATED : July 8, 1997

INVENTOR(S) : Winegard, et. al.

It is certified that error appears in the above-indentified patent and that said Letters Patent is hereby corrected as shown below:

Title page, item [57], Abstract, line 21, replace "to so" with --so--.
Column 1, line 22, replace "BOUY" with --BUOY--.
Column 2, line 62, delete "use,"--.
Column 4, line 36, replace "feed" with --feed horn--.
Column 4, line 37, replace "feed" with --feed horn--.
Column 5, line 44, replace "70" with --700--.
Column 5, line 46, replace "feed" with --feed horn--.

Signed and Sealed this

Twenty-first Day of October 1997

*Attest:*

Bruce Lehman

BRUCE LEHMAN

*Attesting Officer*

*Commissioner of Patents and Trademarks*